US006732813B1

(12) United States Patent
Eklöf

(10) Patent No.: US 6,732,813 B1
(45) Date of Patent: May 11, 2004

(54) METHOD AND DEVICE OF CONTROLLING A ROCK DRILLING MACHINE

(75) Inventor: Åke Eklöf, Skärholmen (SE)

(73) Assignee: Atlas Copco Rock Drills AB, Orebro (SE)

( * ) Notice: Subject to any disclaimer, the term of this patent is extended or adjusted under 35 U.S.C. 154(b) by 43 days.

(21) Appl. No.: 10/111,235

(22) PCT Filed: Oct. 13, 2000

(86) PCT No.: PCT/SE00/01985

§ 371 (c)(1),
(2), (4) Date: Apr. 22, 2002

(87) PCT Pub. No.: WO01/33043

PCT Pub. Date: May 10, 2001

(30) Foreign Application Priority Data

Nov. 3, 1999 (SE) ..... 9903974

(51) Int. Cl.[7] ..... E21B 7/00
(52) U.S. Cl. ..... 173/1
(58) Field of Search ..... 173/1, 8, 9, 10, 173/11, 13, 19, 105, 177, 4; 175/27

(56) References Cited

U.S. PATENT DOCUMENTS 3,823,784 A * 7/1974 Feucht ..... 173/1
3,979,944 A 9/1976 Salmi et al.
4,023,626 A 5/1977 Salmi et al.
4,246,973 A * 1/1981 Mayer ..... 173/8
4,356,871 A * 11/1982 Fujikawa ..... 173/8
4,440,236 A 4/1984 Shiihara et al.
4,711,090 A * 12/1987 Hartiala et al. ..... 60/422
5,121,802 A * 6/1992 Rajala et al. ..... 173/1
5,129,464 A * 7/1992 Richier ..... 173/1

* cited by examiner

*Primary Examiner*—Stephen F. Gerrity
*Assistant Examiner*—Thanh Truong
(74) *Attorney, Agent, or Firm*—Mark P. Stone

(57) ABSTRACT

A method and device for controlling a rock drilling machine (51) includes an impact device (5) arranged to act on a drilling tool (52), a rotation motor (7) for rotating the drilling tool (52), and a feed motor (6) for feeding the drilling tool (52) against a ground surface (53). The pressure to an inlet (30) of the rotation motor (7) is sensed, and the pressure to an inlet (32) of the feed motor (6) is reduced, for the purpose of maintaining the pressure to the rotation motor substantially constant, when the pressure to the inlet (30) of the rotation motor (7) exceeds a first predetermined value (41). When the pressure to the inlet (30) of the rotation motor (7) exceeds a second predetermined value (42), the pressure to an inlet (31) of the impact device (5) is controlled to be inversely proportional to the pressure to the inlet (30) of the rotation motor (7).

2 Claims, 2 Drawing Sheets

METHOD AND DEVICE OF CONTROLLING A ROCK DRILLING MACHINE

BACKGROUND OF THE INVENTION

The present invention relates to a method and a device for controlling a rock drilling machine where the rock drilling machine comprises an impact device for exerting a drilling tool for impacts, a rotation motor for rotating the drilling tool and a feed motor for feeding the drilling tool toward a ground. The ground can be rock, earth or other material for which rock drilling machines normally are used.

In a previously known method the pressure to the rotation motor is kept constant up to a first predetermined value. This value corresponds, for a given rotation motor, to a predetermined tightening moment for the thread joints in the drill string. When this predetermined value is passed the pressure to the feed motor is reduced in order to keep the pressure to the rotation motor substantially constant. One desires to keep the braking moment substantially constant in order to keep the thread joints sufficiently tightened for efficient drilling at the same time as the tightening is not allowed to be so hard that great difficulties , are obtained at subsequent loosening of the thread joints. If the pressure to the rotation motor in spite of this increases to a second predetermined value the pressure to the impact device is changed from full drilling pressure to collaring pressure. This occurs instantaneously. This causes a risk for jamming since the sudden decrease of the impulse to the impact device causes an instantaneous increase of the feed force.

SUMMARY OF THE INVENTION

The present invention, which is defined in the subsequent claims, aims at avoiding the above mentioned jamming problems. This is achieved by controlling the pressure to the inlet of the impact device inversely proportionally to the pressure to the inlet of the rotation motor when the pressure to the inlet of the rotation motor exceeds a second predetermined value.

BRIEF DESCRIPTION OF THE DRAWINGS

An embodiment of the invention is described below with reference to the accompanying drawings in which.

BEST MODES FOR CARRYING OUT THE INVENTION

Figure 1:
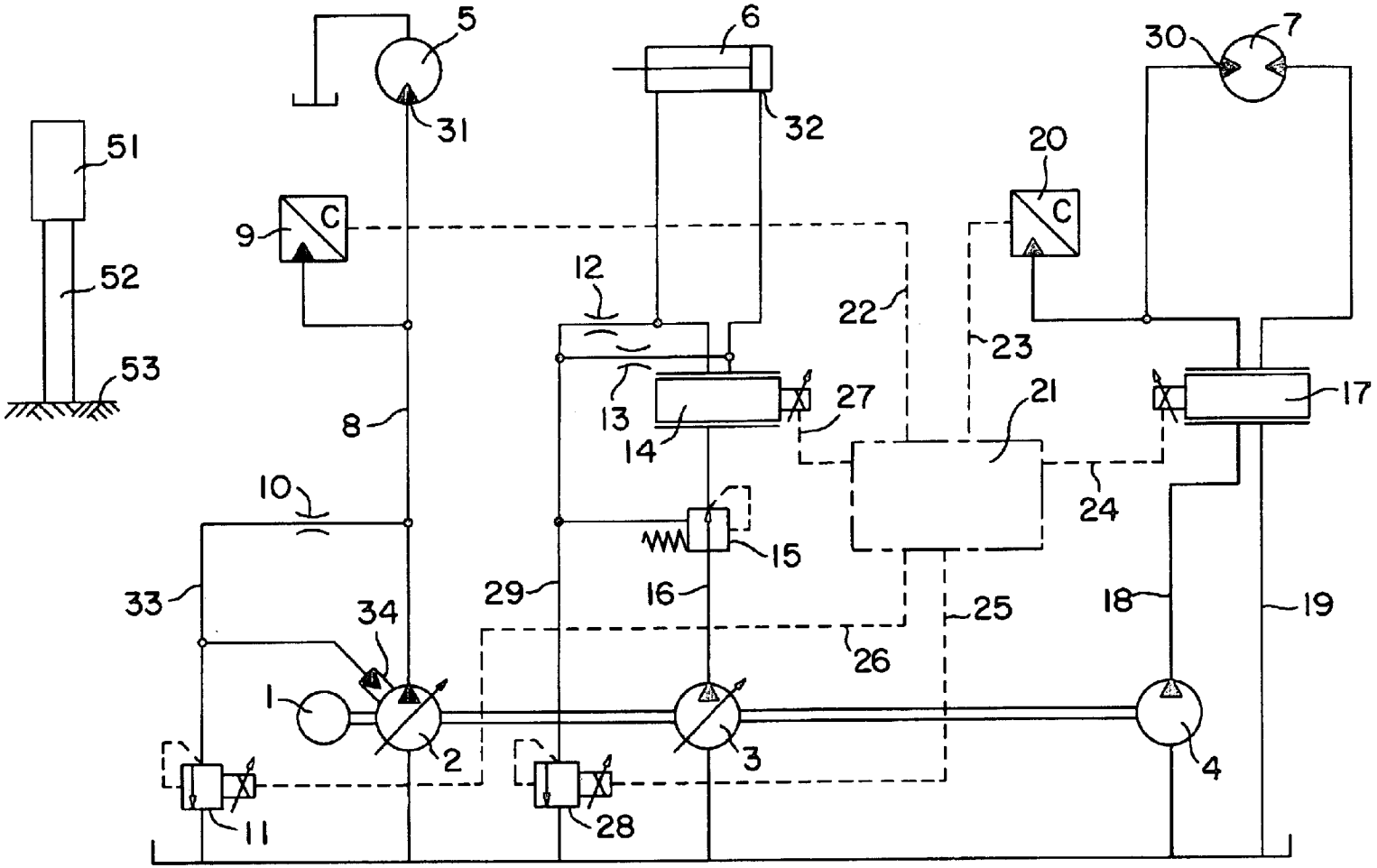
FIG. 1 shows a schematic rock drilling machine and a schematic hydraulic diagram belonging thereto in which the present invention is used.

The rock drilling machine 51 shown in the drawing comprises a motor 1 which drives a pump 2 with variable displacement, a pump 3 with variable displacement, and a pump 4 with fixed displacement. From pump 2 pressure liquid is led through conduit 8 to the inlet 31 of the impact device 5 of the rock drilling machine 51. A pressure transducer 9 is connected to conduit 8 in order to sense the pressure at the inlet 31. From conduit 8 there is a conduit 33 provided with a restriction 10 and a pressure limiter 11. Pump 2 is provided with an adjusting means 34 for adjustment of the displacement of pump 2. The adjusting means 34 is connected to conduit 33. From pump 3 pressure liquid is led through conduit 16 and valve 15 to a proportional directional valve 14 for controlling the feed motor 6 of the rock drilling machine 51. When the proportional directional valve 14 is adjusted for drilling, the pressure liquid is led to the inlet 32 of the feed motor 6. Valve 15 forms together with restrictions 12 and 13 a pressure compensation which is remotely controlled by the pressure limiter 28 by means of which the feed pressure to the feed motor 6 of the rock drilling machine 51 is controlled. The pressure limiter 28 is arranged in a return conduit 29. From pump 4 pressure liquid is led through conduit 18 to a proportional directional valve 17 for controlling the rotation motor 7 of the rock drilling machine 51. When the proportional directional valve 17 is adjusted for drilling the pressure liquid is led to the inlet 30 of the rotation motor 7. A pressure transducer 20 is connected for sensing the pressure at the inlet 30 of the rotation motor 7. From the proportional directional valve 17 a return conduit 19 leads to tank. Pressure transducer 9 is by means of a conductor 22 connected to a control unit 21. Pressure transducer 20 is by means of a conductor 23 connected to the control unit 21. The proportional directional valve 17 is by means of a conductor 24 connected to the control unit 21 The pressure limiter 28 is by means of a conductor 25 connected to the control unit 21. The pressure limiter 11 is by means of a conductor 26 connected to the control unit 21. The proportional valve 14 is by means of a conductor 27 connected to the control unit 21.

Figure 2:
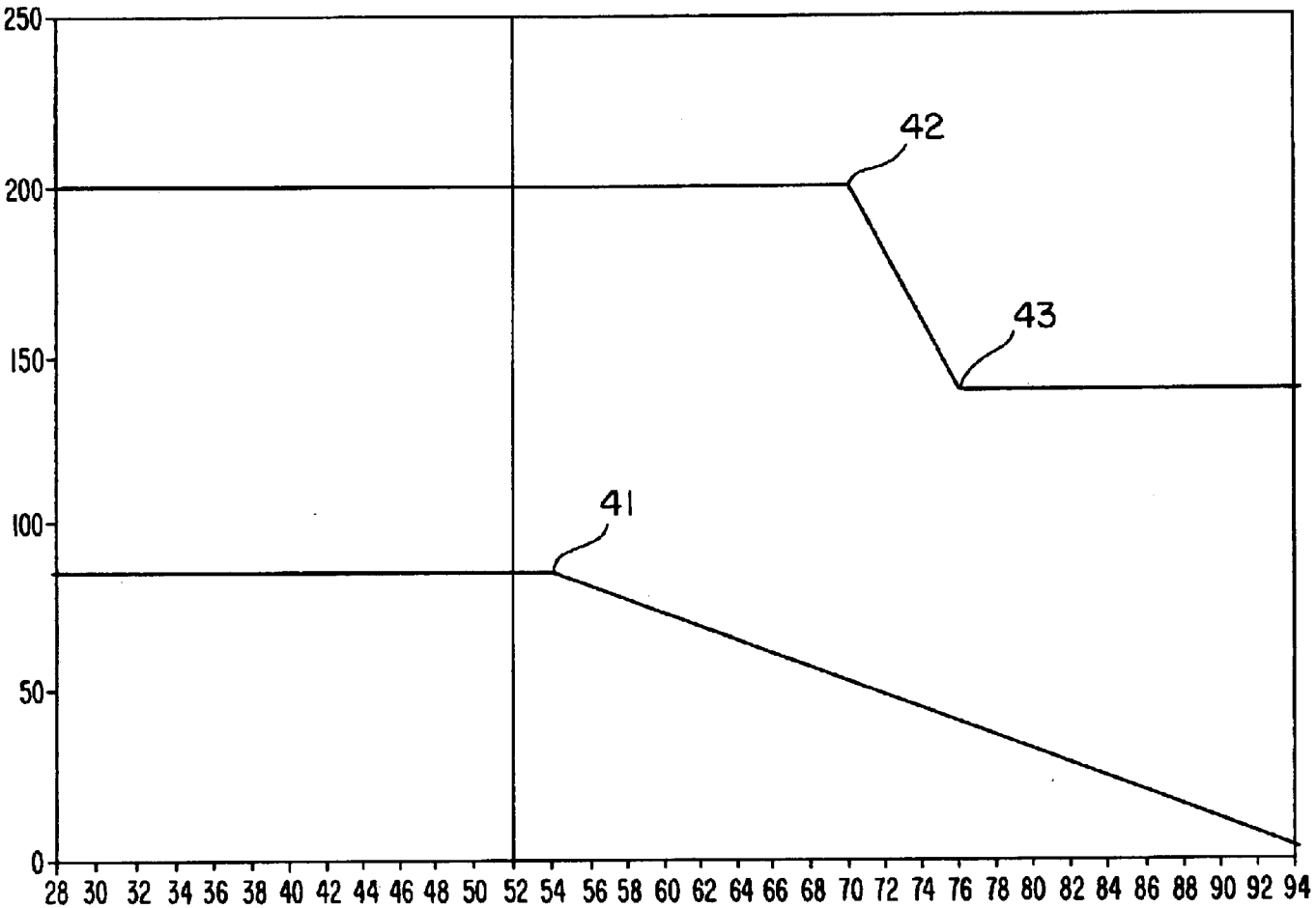
FIG. 2 shows an example of how the impact device pressure varies as a function of the rotation pressure in a rock drilling machine according to the present invention.

In the upper part of FIG. 2, the pressure to the impact device is shown as a function of the pressure to the rotation motor 7, and in the lower part, the pressure to the feed motor 6 as a function of the pressure to the rotation motor 7. The pressure to the rotation motor, which corresponds to the braking moment on the drilling tool 52 when this during drilling is fed against the ground 53, is shown on the horizontal axis. When the drilling tool 52 is fed against the ground 53, the braking moment increases a result, the pressure to the rotation motor 7 increases. When this pressure reaches a first predetermined value 41, the control unit 21 adjusts the proportional pressure limiter 28 such that the valve 15 decreases the pressure to the inlet 32 of the feed motor 6 as shown in FIG. 2. The pressure to the feed motor 6 never decreases to zero but is maintained at a low pressure so that the rock drilling machine can move forwards also at low impact device pressure. When the pressure to the rotation motor reaches a second predetermined value 42, the control unit 21 adjusts the pressure limiter 11 so that the pressure to the impact device 5 is decreased inversely proportionally to the pressure to the rotation motor 7 as shown in FIG. 2. This decrease of the pressure to the impact device 5 continues until the impact device pressure has decreased to the collaring pressure at 43.

What is claimed is:

1. Method of controlling a rock drilling machine (51), where the rock drilling machine comprises an impact device (5) for exerting a drilling tool (52) to impacts, a rotation motor (7) for rotating the drilling tool (52), and a feed motor (6) for feeding the drilling tool (52) against a ground (53), the steps of said method comprising sensing (20) the pressure to an inlet (30) of the rotation motor (7) and reducing the pressure to an inlet (32) of the feed motor (6) when the pressure to the inlet (30) of the rotation motor exceeds a first predetermined value (41) in order to keep the pressure to the rotation motor substantially constant, characterized by the step of controlling the pressure to an inlet (31) of the impact device (5) inversely proportionally to the pressure to the inlet of the rotation motor when the pressure to the inlet of the rotation motor exceeds a second predetermined value (42).

2. Device for controlling a rock drilling machine (51) comprising an impact device (5) for exerting a drilling tool (52) to impacts, a rotation motor (7) for rotating the drilling tool (52), a feed motor (6) for feeding the drilling tool (52) against a ground (53), means (20) for sensing the pressure to an inlet (30) of the rotation motor (7), and means (15) for reducing the pressure to an inlet (32) of the feed motor (6) when to the means (20) for sensing the pressure to the inlet (30) of the rotation motor (7) senses that a first predetermined value (41) has been exceeded, characterized by means (11) for reducing the pressure to an inlet (31) of the impact device (5) inversely proportionally to the pressure to the inlet (30) of the rotation motor (7) when the means (20) for sensing the pressure to the inlet (30) of the rotation motor (7) senses that a second predetermined value (42) has been exceeded.

* * * * *

UNITED STATES PATENT AND TRADEMARK OFFICE

CERTIFICATE OF CORRECTION

PATENT NO. : 6,732,813 B1
DATED : May 11, 2004
INVENTOR(S) : Ake Eklof

It is certified that error appears in the above-identified patent and that said Letters Patent is hereby corrected as shown below:

Column 1,
Line 18, after “passed”, add -- , --.
Line 27, after “value”, add -- , --.

Column 2,
Line 13, after “drilling”, add -- , --.
Line 35, delete “increases a”, and substitute -- increases. As a --.

Column 3,
Line 8, delete “to” (first occurrence).

Signed and Sealed this

Tenth Day of August, 2004

JON W. DUDAS
*Acting Director of the United States Patent and Trademark Office*